United States Patent [19]

Boffer

[11] Patent Number: 4,539,926

[45] Date of Patent: Sep. 10, 1985

[54] BOARD-LIKE FLOATING BODY

[76] Inventor: Jürgen Boffer, Biewerer Str. 168a, D-5500 Trier, Fed. Rep. of Germany

[21] Appl. No.: 558,781

[22] Filed: Dec. 6, 1983

[30] Foreign Application Priority Data

Dec. 18, 1982 [DE] Fed. Rep. of Germany ..... 3246918

[51] Int. Cl.[3] ..... B63B 39/02

[52] U.S. Cl. ..... 114/39; 114/124; 114/153; 114/363

[58] Field of Search ..... 114/39, 39.2, 43, 121, 114/124, 153, 363; 440/14

[56] References Cited

U.S. PATENT DOCUMENTS

| | | | |
|---|---|---|---|
| 2,238,464 | 4/1941 | Fletcher | 114/43 |
| 2,631,559 | 3/1953 | Jones | 114/153 X |
| 2,809,604 | 10/1957 | Meredith | 440/14 |
| 2,968,273 | 1/1961 | Corbett et al. | 114/153 |

*Primary Examiner*—Sherman D. Basinger

*Attorney, Agent, or Firm*—Ward Brown; Robert W. Beach

[57] ABSTRACT

A board-like floating body has a fixed mast, a swingable sail fastened to the mast, and an outrigger which is arranged so as to be swingable about an axis perpendicular to the upper side of the floating body and which has a seat and is intended to carry or support an operator. To compensate for fairly great keeling, the outrigger is connected to one end of a tension spring, the other end of which is fastened to the floating body, so that, in the rest position, the outrigger is disposed in the longitudinal direction of the floating body and behind the mast in the direction of travel. The outrigger is also provided with cable pulls, for manual swinging of the outrigger, and with foot control pedals which are operatively connected by way of a Bowden cable or wire to a rudder blade which is rotatably connected to the floating body.

13 Claims, 5 Drawing Figures

5
4
6
7
11
1
9
2
12
8
10
3

BOARD-LIKE FLOATING BODY

TECHNICAL FIELD

This invention relates to a board-like floating body having a fixed mast, a swingable sail fastened to the mast, and an outrigger which is arranged so as to be swingable about an axis perpendicular to the upper side of the floating body and which has a seat and is intended to carry or support an operator.

BACKGROUND ART

In one known such floating body, the operator when seated on the seat of the outrigger, is usually supported with one or both feet on the upper side of the floating body in order thus, by appropriate positioning of the outrigger, to compensate for keeling of the floating body which occurs as a result of wind pressure. Since the operator has to support himself by his feet on the upper side of the floating body, the maximum outswinging position of the outrigger is limited and accordingly only limited keeling can be compensated for by the weight of the operator. A further disadvantage is that in the outswinging position of the outrigger steering of the floating body as well as operation of the sail is made more difficult.

Another known floating body which is similar to a catamaran has a swingably-arranged sail and a seat which is swingable about the foot of the mast. In this floating body, too, the operator seated on the seat is supported by his feet on the floating body.

OBJECT OF THE INVENTION

An object of the present invention is to provide a floating body, of the kind mentioned at the beginning hereof, in which greater keeling of the floating body than hitherto can be compensated for and which is, at the same time, easier to manipulate and transport than hitherto such that it is particularly suitable for use by less experienced persons.

SUMMARY OF THE INVENTION

This object is achieved in accordance with the invention in that the outrigger is connected to one end of a tension spring, the other end of which is fastened to the floating body so that, in the rest position, the outrigger is disposed in the longitudinal direction of the floating body and behind the mast in the direction of travel, in that the outrigger is provided with cable pulls and is swingable by hand, and in that a foot control pedal is carried by the outrigger, which pedal is operatively connected by way of a Bowden cable or wire to a rudder blade which is rotatably connected to the floating body.

Advantageously, the seat on the outrigger is positively guided so as to be displaceable in the longitudinal direction of the outrigger by way of a cable or the like which is connected to the seat and to the floating body, so that, in the rest position of the outrigger, the seat is disposed near the mast, whereas, with the outrigger swung through 90°, the seat is disposed close to the free end of the outrigger. Indeed, the seat itself may be connected to the floating body by way of the tension spring.

The outrigger is conveniently arranged so as to be swingable about the foot of the mast. In this respect the outrigger is preferably fastened to a rotatable sleeve which encircles the foot of the mast.

In an advantageous embodiment of the invention, the seat is guided so as to be displaceable in the manner of a sliding carriage in a groove of the outrigger which is U-shaped in cross-section and extends in the longitudinal direction of the outrigger. Preferably, a pulley is provided near the free end of the outrigger and the cable connected to the seat and to the floating body in the vicinity of the mast is guided over this pulley.

BRIEF DESCRIPTION OF THE DRAWINGS

The invention will be described further, by way of example, with reference to the accompanying drawings, in which.

DETAILED DESCRIPTION OF THE ILLUSTRATED EMBODIMENTS

Figure 1:
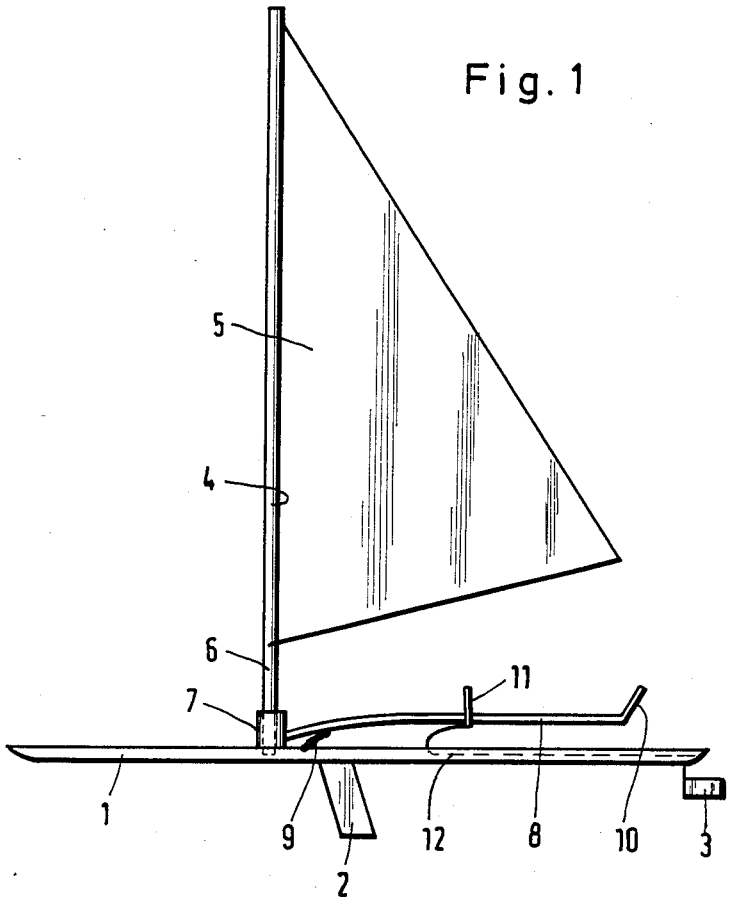
FIG. 1 is a side view of a first embodiment of a floating body in accordance with the invention.
Figure 2:
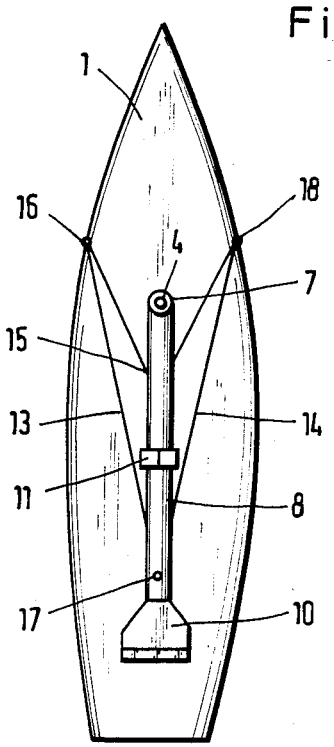
FIG. 2 is a plan view of the floating body shown in FIG. 1.

In a first embodiment of the invention, as shown in FIGS. 1 and 2, a substantially board-like floating body 1 has, on its underside, a center board 2 as well as a swingable rudder blade 3. Fastened on the upper side of the floating body 1, approximately at the center of gravity thereof, is a mast 4 which carries a sail 5 which is swingable about the mast 4.

A rotatable sleeve 7 encircles the foot 6 of the mast and is connected to an outrigger 8. The outrigger 8 is held in its rest position in the longitudinal direction of the floating body and behind the mast 4 in the direction of travel, (as is shown in FIG. 2) by a tension spring 9.

Near its free end, the outrigger 8 carries a seat 10. The outrigger 8 also has foot control pedals 11 which are connected by way of a Bowden cable or wire 12 to the rudder blade 3.

As further revealed by FIG. 2, cable pulls 13 and 14 are connected between the outrigger 8 and the floating body 1. The cable pull 13 is fastened at 15 to the outrigger 8, and extends over a pulley 16 or the like fastened to the floating body 1, then back to a pulley 17 carried on the outrigger and extends therefrom as the cable pull 14 over a pulley 18 fastened to the floating body and back to the point 15 of the outrigger 8.

Upon use of the floating body, the operator is supported on the seat 10 and can operate the sail 5 in the usual manner as in a sailing boat. Steering of the floating body 1 is effected by the operator with the aid of the rudder blade 3 in a simple manner by way of the foot control pedals 11 and the Bowden cable 12.

However, as soon as keeling of the floating body because of wind pressure becomes too great, the operator can, by simple actuation of the cable pull portion 13 or 14, swing the outrigger 8 in the appropriate direction so that, because of his weight and the lever effect of the outrigger 8, the keeling due to the wind pressure is compensated for. Thus in a simple way high speeds can be achieved even by inexperienced operators.

Figure 3:
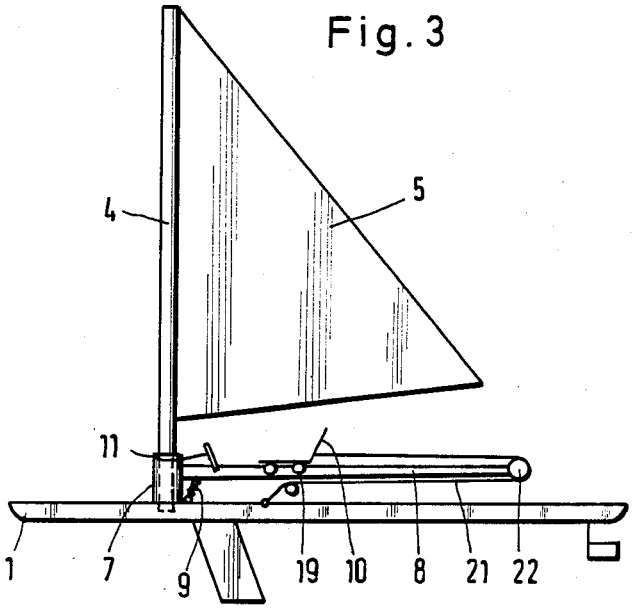
FIG. 3 is a side view of a second embodiment of the floating body of the invention which has a displaceable seat.
Figure 4:
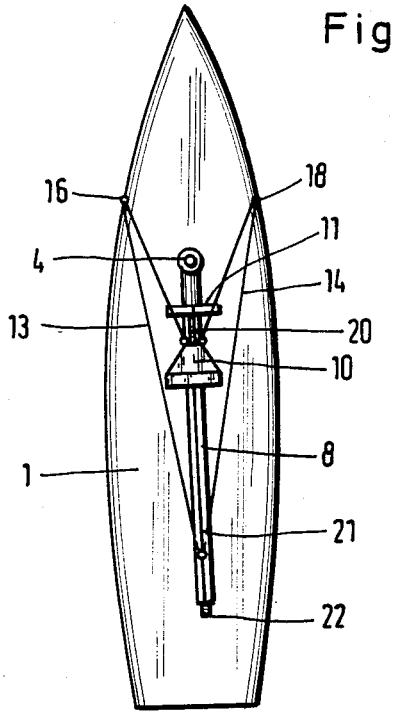
FIG. 4 is a plan view of the floating body shown in FIG. 3 with the outrigger in the rest position.
Figure 5:
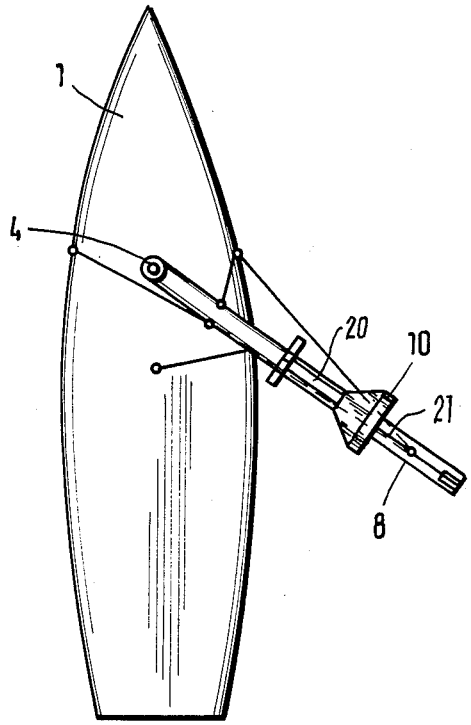
FIG. 5 is a plan view of the floating body shown in FIG. 3, with the outrigger partially swung out.

In the embodiment of the floating body of the invention shown in FIGS. 3 to 5, the seat 10 is displaceably guided on the outrigger 8 in the longitudinal direction of the outrigger by virtue of rollers 19 on the seat 10 engaging in a U-shaped groove in the outrigger 8. The foot control pedals 11 are connected to the seat 10 by way of a connecting rod 20. Furthermore, the connecting rod 20 is connected to the spring 9, so that in the rest position the outrigger 8 is arranged in the longitudinal direction of the floating body behind the mast in the direction of travel and the seat 10 is located close to the mast 4. The seat 10 extends by way of a cable 21, which is conducted over a pulley 22 arranged near the free end of the outrigger 8, to the floating body 1 close to the mast 4. Furthermore, in the manner already described, the cable pulls 13 and 14 are connected to the outrigger 8 and the floating body 1.

As indicated in FIG. 5, upon the swinging out of the outrigger 8, the seat 10 is drawn toward the free end of the outrigger by way of the cable 21. Accordingly, when the outrigger 8 has swung out through 90° the seat 10 is arranged close to the free end of the outrigger 8. The spring 9, of course, draws the outrigger 8 and the seat 10 back into their rest positions.

A floating body in accordance with FIGS. 3 to 5 has the advantage that the force acting on the mast 4 as a result of the weight of the user by way of the lever effect of the outrigger 8 is slight and thus in the rest position immersing of the floating body at the stern or at the bow does not occur. When the outrigger 8 is swung out the seat 10 is shifted toward the free end of the outrigger 8 so that the lever effect on the mast 4 becomes greater with increasing swing-out of the outrigger.

I claim:

1. In a board-like floating body having an elongated upper surface and a mast mounted thereon, a sail swingable relative to the mast and an outrigger swingable about an axis perpendicular to the upper surface of the floating body and having a seat for supporting an operator, the improvement comprising spring means biasing the outrigger to a rest position in which the outrigger extends longitudinally of the upper surface of the floating body, cable pull means connected between the outrigger and the floating body for manual swinging of the outrigger relative to such body by the operator, and steering control means carried by and swingable with the outrigger and positioned for manipulation by the operator, said steering control means being mounted on said outrigger at a location between said outrigger swinging axis and said seat.

2. In the floating body defined in claim 1, the steering control means including foot pedals mounted on the outrigger.

3. In the floating body defined in claim 1, the steering control means being manipulatable by the operator independent of swinging of the outrigger.

4. In a board-like floating body having an elongated upper surface and a mast mounted thereon, a sail swingable relative to the mast and an outrigger swingable about an axis perpendicular to the upper surface of the floating body and having a seat for supporting an operator, the improvement comprising spring means biasing the outrigger to a rest position in which the outrigger extends longitudinally of the upper surface of the floating body, cable pull means connected between the outrigger and the floating body for manual swinging of the outrigger relative to such body by the operator, steering control means carried by and swingable with the outrigger and positioned for manipulation by the operator, pivot means swingably mounting the outrigger on the mast, said pivot means including a sleeve encircling the foot of the mast and carrying the outrigger.

5. In a board-like floating body having an elongated upper surface and a mast mounted thereon, a sail swingable relative to the mast and an outrigger swingable about an axis perpendicular to the upper surface of the floating body and having a seat for supporting an operator, the improvement comprising spring means biasing the outrigger to a rest position in which the outrigger extends longitudinally of the upper surface of the floating body, cable pull means connected between the outrigger and the floating body for manual swinging of the outrigger relative to such body by the operator, and steering control means carried by and swingable with the outrigger and positioned for manipulation by the operator, the outrigger swinging axis intersecting the base of the mast.

6. In a board-like floating body having an elongated upper surface and a mast mounted thereon, a sail swingable relative to the mast, an outrigger swingable about an axis perpendicular to the upper surface of the floating body between a rest position in which the outrigger extends longitudinally of the upper surface of the floating body and a swung position in which the outrigger is angled rearward and outward relative to the upper surface of the floating body and a seat mounted on the outrigger for supporting an operator, the improvement comprising the seat being movable longitudinally along the outrigger, and means interconnecting the seat and the outrigger so that the seat is disposed close to the mast when the outrigger is in its rest position but is disposed farther from the mast when the outrigger is in its swung position.

7. In the floating body defined in claim 6, the improvement further comprising steering control means carried by and swung with the outrigger and positioned for manipulation by the operator.

8. In the floating body defined in claim 7, the steering control means including foot pedals mounted on the outrigger.

9. In the floating body defined in claim 6, the outrigger having an upward opening groove extending longitudinally of the outrigger, and the seat having a projection received in said groove for sliding movement of the seat along the outrigger.

10. In the floating body defined in claim 6, a pulley carried at the swinging end portion of the outrigger, and the interconnecting means including cable means having one end portion connected to the floating body, an intermediate portion extending over said pulley and the other end portion connected to the seat.

11. In the floating body defined in claim 6, pivot means swingably mounting the outrigger on the mast.

12. In the floating body defined in claim 11, the pivot means including a sleeve encircling the foot of the mast and carrying the outrigger.

13. In the floating body defined in claim 6, the outrigger swinging axis intersecting the base of the mast.

* * * * *